US005537975A

United States Patent [19]

Cosma et al.

[11] Patent Number: 5,537,975

[45] Date of Patent: Jul. 23, 1996

[54] ELECTRONICALLY CONTROLLED COMPRESSION RELEASE ENGINE BRAKES

[75] Inventors: Gheorghe Cosma, Windsor; Dennis R. Custer, West Granby; John A. Konopka, Feeding Hills; James Usko, North Granby, all of Conn.

[73] Assignee: Diesel Engine Retarders, Inc., Wilmington, Del.

[21] Appl. No.: 320,178

[22] Filed: Oct. 7, 1994

[51] Int. Cl.[6] ..... F02D 13/04

[52] U.S. Cl. ..... 123/322

[58] Field of Search ..... 123/320, 321, 123/322, 323

[56] References Cited

U.S. PATENT DOCUMENTS

| | | | |
|---|---|---|---|
| Re. 33,052 | 9/1989 | Meistrick et al. | 123/321 |
| 3,220,392 | 11/1965 | Cummins | 123/97 |
| 3,743,898 | 7/1973 | Sturman | 317/154 |
| 4,572,114 | 2/1986 | Sickler | 123/321 X |
| 4,838,516 | 6/1989 | Meistrick et al. | 251/77 |
| 4,949,751 | 8/1990 | Meistrick et al. | 137/522 |
| 5,000,145 | 3/1991 | Quenneville | 123/321 |
| 5,012,778 | 5/1991 | Pitzi | 123/321 |
| 5,117,790 | 6/1992 | Clarke et al. | 123/321 |
| 5,146,890 | 9/1992 | Gobert et al. | 123/321 |
| 5,255,650 | 10/1993 | Faletti et al. | 123/322 |

OTHER PUBLICATIONS

Myron Brudnicki, Rotary Ball Valve, NASA Tech Briefs, Mar. 1994.

*Primary Examiner*—Tony M. Argenbright
*Attorney, Agent, or Firm*—Fish & Neave; Robert R. Jackson

[57] ABSTRACT

In engine brakes of the type in which a master piston is reciprocated by an associated internal combustion engine part to hydraulically pressurize hydraulic fluid in a plenum, after which a trigger valve is opened to apply that hydraulic pressure to a slave piston which opens an exhaust valve in the engine to produce a compression release event, an electronically controlled trigger valve is used in place of the conventional mechanically operated trigger valve. The electronically controlled trigger valve can be much simpler and cheaper than the mechanical trigger valve it replaces, and it can also be readily controlled to automatically vary the timing of the compression release events if desired.

9 Claims, 7 Drawing Sheets

ELECTRONICALLY CONTROLLED COMPRESSION RELEASE ENGINE BRAKES

BACKGROUND OF THE INVENTION

This invention relates to compression release engine brakes, and more particularly to improvements to compression release engine brakes of the general type shown, for example, in Meistrick et al. U.S. Pat. Nos. Re. 33,052 and 4,838,516, both of which are hereby incorporated by reference herein.

The above-mentioned Meistrick et al. patents show compression release engine brakes in which, during operation of the engine brake, master hydraulic pistons reciprocated by intake and/or exhaust valve actuating mechanisms in an associated internal combustion engine pressurize the hydraulic fluid in a hydraulic subcircuit against the resilience of additional hydraulic fluid in a plenum. At a predetermined time during the stroke of one of the above-mentioned master pistons, the piston opens a trigger valve which allows the pressurized hydraulic fluid in the above-mentioned subcircuit to flow to a slave piston cylinder. This causes a slave piston in that cylinder to reciprocate, thereby opening an exhaust valve in the internal combustion engine near top dead center of the compression stoke of the engine cylinder served by that exhaust valve. Compressed air in that engine cylinder is thereby released to the exhaust manifold of the engine so that the engine does not recover the work of compressing that air during the subsequent expansion stroke of the engine cylinder. (The engine's fuel is cut off during operation of the engine brake.) The engine brake therefore operates to temporarily convert the engine from a power source to a power-absorbing air compressor. This greatly increases the braking available from the engine to slow down a vehicle propelled by the engine. The need to use the vehicle's wheel brakes is therefore reduced, thereby prolonging wheel brake life and increasing the safety of operation of the vehicle.

While engine brakes of the type shown in the above-mentioned patents work extremely well and have been highly successful, they do involve relatively complex mechanical and hydraulic components. These components are relatively costly and require careful adjustment to achieve the desired precise timing of engine exhaust valve openings. It is also generally difficult or impossible to cause these components to adapt to different engine operating conditions in order to optimize the performance of the engine brake at different engine operating conditions. The engine brake is typically adjusted so that its performance is optimum at one set of operating conditions (e.g., at one engine speed), thereby leaving performance less than optimum at other operating conditions.

In view of the foregoing, it is an object of this invention to improve and simplify compression release engine brakes of the type described above.

It is another object of this invention to improve and optimize the performance of engine brakes of the type described above at all engine speeds and other variable engine operating conditions.

It is still another object of this invention to eliminate the relatively complex mechanical triggering of compression release events in engine brakes of the type described above.

It is yet another object of this invention to provide compression release engine brake apparatus that is simpler to install and adjust, and which can be more easily made to maintain its initial or "design" operating characteristics.

It is still another object of this invention to provide compression release engine brake apparatus which can interface with other apparatus such as engine and vehicle sensors and which can provide various types of programmable braking operation.

SUMMARY OF THE INVENTION

These and other objects of the invention are accomplished in accordance with the principles of the invention by providing compression release engine brakes of the type described above in which pressurized hydraulic fluid is released from the subcircuit pressurized by a master piston by an electronically controlled hydraulic valve. The electronically controlled valve may be a two-way (on/off) valve, or it may be a three-way valve with one port switched between hydraulic connection to each of two other ports. The electronically controlled valve is preferably (but not necessarily) one in which the movable valve element is moved or switched by alternately applying electrical current to two electromagnets in the valve.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
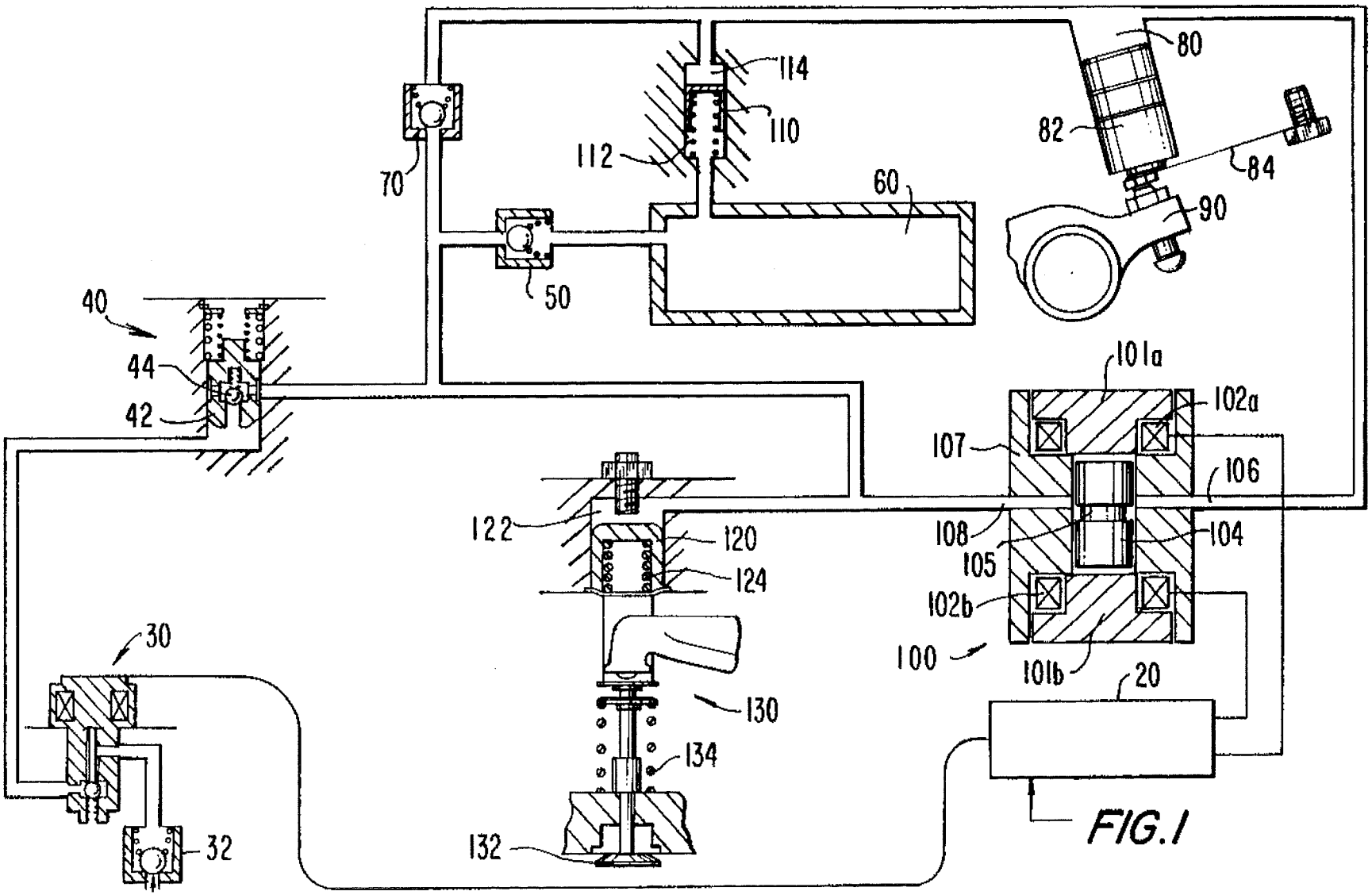
FIG. 1 is a simplified schematic diagram of a representative portion of an illustrative embodiment of a compression release engine brake constructed in accordance with this invention. Portions of the internal combustion engine associated with the engine brake are also shown in FIG. 1.

In the illustrative embodiment shown in FIG. 1 engine brake control module 20 energizes conventional solenoid valve 30 when engine braking is desired. This allows hydraulic fluid (typically engine lubricating oil), supplied at a relatively low pressure by the internal combustion engine associated with the engine brake, to flow to conventional control valve 40. The supply of relatively low pressure hydraulic fluid to control valve 40 raises the spool 42 of that valve to the position shown in FIG. 1 and also opens the check valve 44 in the spool to the extent needed to allow the hydraulic circuit components downstream from control valve 40 to fill with hydraulic fluid at approximately the relatively low pressure mentioned above. In particular, plenum 60 is pressurized through check valve 50, and master piston cylinder 80 is filled through return check valve 70.

The above-described low pressure hydraulic fluid has sufficient pressure in master piston cylinder 80 to push master piston 82 out (against relatively weak master piston return spring 84) into contact with exhaust valve actuating mechanism 90 in the associated internal combustion engine. (Depicted exhaust valve actuating mechanism 90 is typically associated with a different engine cylinder than is served by depicted exhaust valve 132 (and therefore by depicted slave piston 120). For example, the following table shows how the master and slave pistons may be correlated with one another in an engine brake for a typical six-cylinder, in-line engine with firing order 1, 5, 3, 6, 2, 4. (Other engines with different firing order will require different correlation.)

| Master Piston Engine Cylinder No. | Related Slave Piston Engine Cylinder No. |
|---|---|
| 1 | 3 |
| 2 | 1 |
| 3 | 2 |
| 4 | 5 |
| 5 | 6 |
| 6 | 4 |

Thus the first line in this table indicates that the slave piston 120 for engine cylinder 3 is in a hydraulic subcircuit with a master piston 82 reciprocated by the exhaust valve actuating mechanism for engine cylinder 1. Those skilled in the art will appreciate that other arrangements of these hydraulic subcircuits are possible, and also that the master pistons 82 can be alternatively driven by other engine components such as intake valve actuating mechanisms or fuel injector mechanisms.

When master piston 82 contacts its associated exhaust valve actuating mechanism 90 as described in the preceding paragraph, each oscillation of mechanism 90 causes master piston 82 to reciprocate. Indeed, FIG. 1 shows master piston 82 at or near the end of the forward stroke of such a reciprocation. Each forward stroke of master piston 82 greatly increases the pressure of the hydraulic fluid in the hydraulic subcircuit which includes master piston cylinder 80. For example, the pressure in this subcircuit may peak at about 2000 to 3000 p.s.i. This is due to the fact that trigger valve 100 (described in more detail below) is closed during most or all of each forward stroke of master piston 82. Accordingly, the hydraulic fluid flow from master piston cylinder 80 can only be absorbed by displacement of delay piston 110 as shown in FIG. 1. Of course, such displacement of delay piston 110 is strongly resisted by the relative incompressibility of the hydraulic fluid in plenum 60 (and also by return spring 112). Thus very high pressure is produced in the hydraulic fluid in the subcircuit which includes master piston cylinder 80 and delay piston cylinder 114.

When it is time for slave piston 120 to produce a compression release event in the associated internal combustion engine (e.g., when the engine cylinder associated with slave piston 120 is at about 30° before top dead center of its compression stoke), engine brake control module 20 energizes coil 102*a* in trigger valve 100. This causes the spool 104 in valve 100 to move toward coil 102*a* due to electromagnetic attraction of the spool to ferromagnetic pole piece 101*a*, thereby opening a passageway 105 through valve 100 from its inlet 106 to its outlet 108. (A spool-type trigger valve 100 is shown in FIG. 1 only for purposes of initial discussion. Other types of electrically controlled hydraulic trigger valves can be used instead if desired, and several other examples of suitable valves are shown in other FIGS. and described below.) The opening of valve 100 allows the pressurized hydraulic fluid in plenum 60 (and spring 112) to force hydraulic fluid out of delay piston cylinder 114 toward slave piston cylinder 122. Assuming that the pressure of this hydraulic fluid is great enough, slave piston 120 is thereby forced down so that it contacts exhaust valve opening mechanism 130 and opens exhaust valve 132 to produce a compression release event in the engine. If the hydraulic fluid pressure is not initially great enough to open exhaust valve 132 against the pressure of the gas in the engine cylinder (and the force of return springs 124 and 134), hydraulic fluid from trigger valve outlet 108 will flow through check valve 50 into plenum 60, thereby increasing the pressure available in the plenum during subsequent strokes of master piston 82. The plenum pressure will quickly become sufficient to open exhaust valve 132 and produce compression release events.

After trigger valve 100 has been open long enough to produce a compression release event as described above, control module 20 energizes coil 102*b* of trigger valve 100. For example, this may be done when the engine cylinder associated with slave piston 120 is at about 90° after top dead center of each compression stroke. Energizing coil 102*b* causes spool 104 to move down due to electromagnetic attraction of the spool to ferromagnetic pole piece 101*b*, thereby closing valve 100 by removing passageway 105 from alignment with valve ports 106 and 108.

When exhaust valve actuating mechanism 90 allows master piston 82 to perform its return stroke, springs 124 and 134 cause slave piston 120 to perform its return stroke. Check valve 70 allows hydraulic fluid to flow in the direction from slave piston cylinder 122 to master piston cylinder 80, thereby propelling the return stroke of master piston 82 and keeping master piston cylinder 80 full of hydraulic fluid.

When engine braking is no longer desired and the engine brake is accordingly turned off, control module 20 de-energizes solenoid valve 30. This relieves the hydraulic fluid pressure beneath control valve spool 42, thereby allowing that spool to drop. The next time trigger valve 100 opens, the subcircuit including delay piston cylinder 114 and master piston cylinder 80 vents over the top of spool 42. This allows slave piston return spring 84 to remove slave piston 82 from contact with mechanism 90, thereby terminating the operation of the engine brake.

Control module 20 may be a conventional microprocessor augmented by conventional memory for a control program and control data. Typical inputs to control module 20 include: (1) an engine braking request signal (e.g., from a vehicle dashboard switch operable by the driver of the vehicle), (2) a "no fuel" signal indicative that fuel to the engine has been cut off, (3) a "clutch engaged" signal indicative that the vehicle clutch is engaged, and (4) a "crank or camshaft position" signal indicative of the angular position of the engine crankshaft or camshaft (necessary to synchronize the timing of the signals applied to trigger valve 100 with the motion of the engine piston in the engine cylinder associated with slave piston 120.)

If it is desired to provide even more sophisticated control of the timing of compression release events, additional inputs such as the following may be applied to control module 20: (5) engine speed, (6) engine cylinder pressure, (7) turbocharger boost pressure, (8) ambient air temperature, (9) ambient barometric pressure, and/or (10) other engine parameters. The above-mentioned "ambient" temperature and barometric pressure measurements can be taken at any convenient and suitable locations such as outside the engine or anywhere along the engine air intake structure. These kinds of inputs can be used to enable control module 20 to advance or retard the compression release events depending on various engine operating parameters. For example, compression release events may be delayed at relatively low engine speed to maximize engine braking, while at higher engine speed the compression release events may be somewhat advanced to prevent excessively large loads on the engine components which operate the engine brake and/or which are operated on by the engine brake. Compression release events may also be delayed at high ambient air temperature and/or at low barometric pressure to compensate for the reduced mass of air that the engine takes in under such conditions.

As an example of the range over which the timing of compression release events may be varied by control module 20, trigger valve may be opened at anywhere from about 20° to about 40° before top dead center of the compression strokes of the associated engine cylinder, depending on the operating conditions of the engine and the amount of engine braking desired under those conditions. Control module 20 may perform a predetermined algorithm to compute the appropriate compression release event timings based on the above-described inputs to the control module, or control module 20 may use a look-up table to look up those timings in a previously stored body of data.

Another example of how control module 20 may be used to vary engine braking is analogous to so-called "cruise control" during power mode operation of the engine. In this example, the driver of the vehicle sets a desired engine speed or vehicle speed, and the engine brake automatically adjusts the timing of compression release events to produce the amount of engine braking needed to maintain that speed. As a consequence, the vehicle would automatically maintain a desired speed on long downgrade, despite variations in the slope of that downgrade.

Additional information regarding suitable engine brake control is provided below in connection with FIG. 9, and also in concurrently filed, commonly assigned application Ser. No. 08/320,049, which is hereby incorporated by reference herein.

As has been mentioned, trigger valve 100 may be any suitable, electronically controllable, hydraulic valve. The two-coil, two-way, spool-type valve shown in FIG. 1 may have certain desirable features. Such valves can be operated very rapidly with very little power. The coils do not have to overcome any significant hydraulic pressure differential. Nor does either coil have to overcome a return spring force. The spool can be latched in each of its two positions either by a small holding current in the coil to which the spool was last attracted, or residual magnetism may be sufficient to latch the spool, thereby making even small holding currents unnecessary. Because of the low power requirements, the valve can be switched very rapidly for prolonged periods without any significant temperature rise due to electrical resistance heating.

In general, whether the hydraulic trigger valve is a spool valve such as shown in FIG. 1 or another type of valve (additional examples of which are shown and described below), desirable characteristics of suitable valves include (1) the ability to switch hydraulic fluid at high pressure, (2) rapid response time (e.g., about 1–3 milliseconds), (3) low voltage operation (e.g., directly using the vehicle system voltage), (4) high hydraulic fluid flow rates, and (5) good frequency response.

Figure 2:
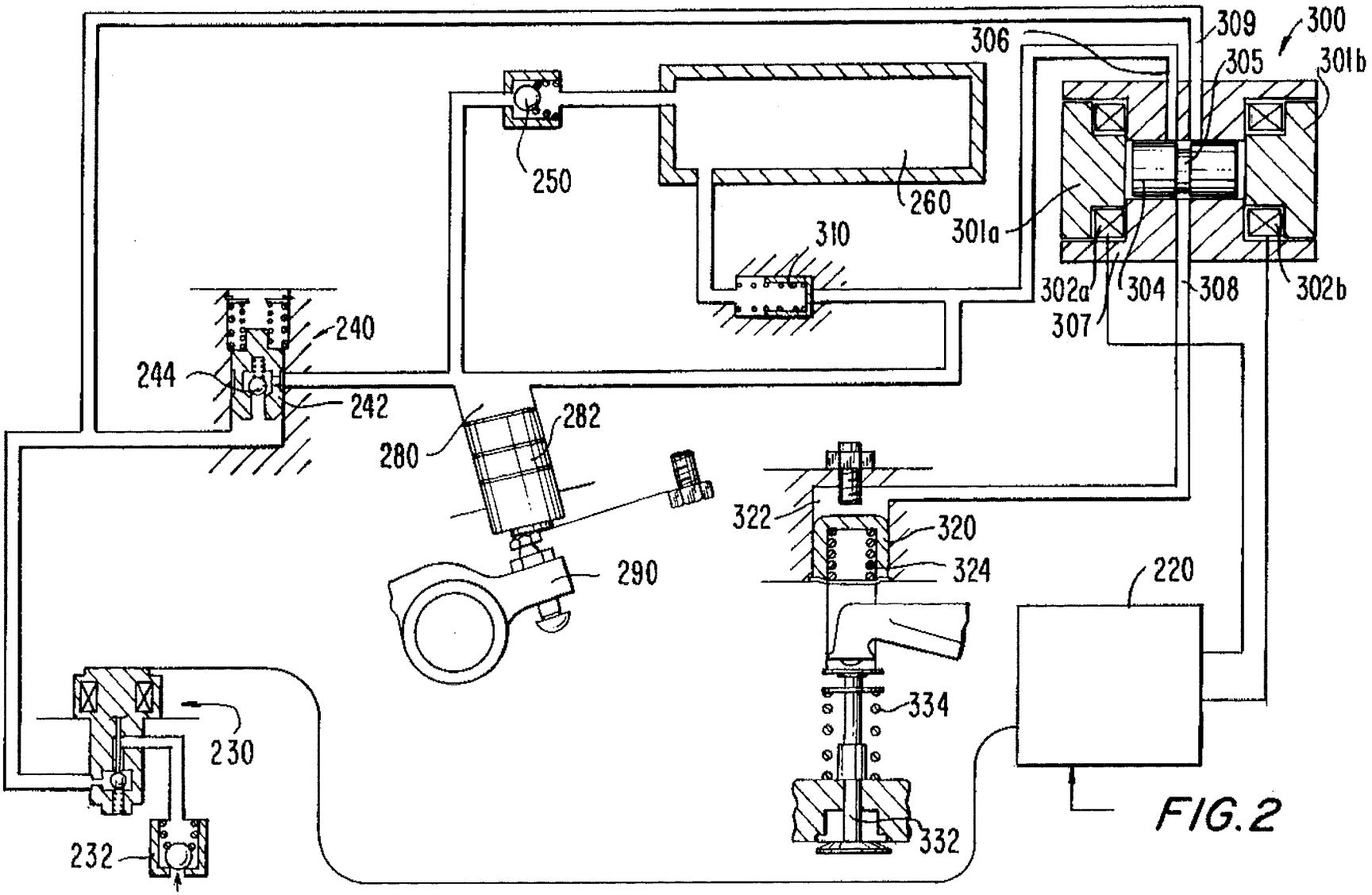
FIG. 2 is a view similar to FIG. 1 showing an alternative embodiment of a compression release engine brake constructed in accordance with this invention.

An alternative embodiment of a compression release engine brake constructed in accordance with this invention is shown in FIG. 2. In FIG. 2 elements that are the same as or similar to elements in FIG. 1 have reference numbers that are increased by 200 from the reference numbers used in FIG. 1. As in FIG. 1, when compression release engine braking is desired, control module 220 energizes solenoid valve 230. This allows low pressure hydraulic fluid (engine oil) from the engine and inlet check valve 232 to flow through solenoid valve 230 to control valve 240. The low pressure hydraulic fluid raises control valve spool 242 to the position shown in FIG. 2, and also opens the check valve 244 in that spool to charge the hydraulic subcircuit downstream from the control valve with low pressure hydraulic fluid. Control module 220 initially uses coil **302*b* to position the spool 304 of two-coil, three-port trigger valve 300 so that its inlet port 306 is closed and so that its exhaust port 309 is hydraulically connected to its slave piston port 308 via passageway 305. Plenum 260 is filled through check valve 250. The low pressure hydraulic fluid in master piston cylinder 280 pushes master piston 282 out into contact with engine exhaust rocker mechanism 290**.

Each counterclockwise oscillation of exhaust rocker 290 raises master piston 282. This further pressurizes plenum 260 and causes delay piston 310 to shift to the left, compressing the hydraulic fluid in plenum 260 and storing the hydraulic fluid quantity and energy that will be necessary to produce a forward stroke of slave piston 320 when valve 300 is triggered as described below.

When it is time to produce a compression release event in the engine cylinder served by slave piston 320, control module 220 energizes coil **302*a* in trigger valve 300. This causes spool 304 in the control valve to shift toward coil 302*a* due to electromagnetic attraction between spool 304 and pole piece 301*a*, thereby closing the hydraulic connection between ports 308 and 309 and making a hydraulic connection via passageway 305 between ports 306 and 308. High pressure hydraulic fluid is thereby supplied to slave piston cylinder 322, which drives down slave piston 320 to open engine exhaust valve 332** and produce a compression release event in the engine cylinder served by that exhaust valve.

After the compression release event has been produced, control-module 220 energizes coil **302*b* in trigger valve 300. This shifts spool 304 back toward pole piece 301*b*, thereby closing the hydraulic connection between ports 306 and 308 and re-opening the hydraulic connection between ports 308 and 309. Return springs 324 and 334 are then able to propel a return stroke of slave piston 320, with hydraulic fluid flowing in the direction from slave piston cylinder 322 to the low pressure portion of the hydraulic circuit which is upstream from control valve 240. When exhaust rocker 290 subsequently performs its return stroke, check valve 244 opens to propel a return stroke of master piston 282 and keep master piston cylinder 280 filled with hydraulic fluid. The engine brake is therefore ready to perform another cycle of operation after the next forward stroke of exhaust rocker 290**.

When engine braking is no longer desired, control module 220 de-energizes solenoid valve 230. This depressurizes the low pressure portion of the hydraulic circuit through the check valve in the bottom of the solenoid valve. Control valve spool 242 therefore drops, which vents the high pressure portion of the circuit over the top of the spool.

Control module 220 may be entirely similar to control module 20 and may receive the same kinds of inputs that control module 20 receives. Valve 300 has many of the same operating characteristics and advantages as valve 100.

Figure 3:
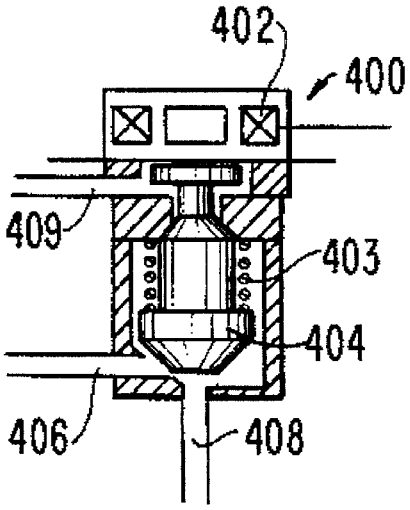
FIG. 3 is a simplified sectional view of another type of electronically controlled trigger valve that can be used in the engine brake shown in FIG. 2.

Although two-coil, spool-type valves such as valves 100 and 300 have been shown in FIGS. 1 and 2, other types of electronically controlled hydraulic trigger valves can be used if desired. For example, FIG. 3 shows an electronically controlled poppet type valve 400 that can be substituted for valve 300 in the system of FIG. 2 if desired. (FIG. 3 shows valve 400 with its coil 402 energized as described below.) Ports 406, 408, and 409 correspond respectively to ports 306, 308, and 309 in FIG. 2. Shuttle 404 is resiliently urged downwardly by prestressed compression coil spring 403. In the downward-most position shuttle 404 closes off port 406 but opens port 409. Port 408 is open at all times. When coil 402 is energized, shuttle 404 moves up, thereby opening port 406 and closing port 409. It will thus be seen that valve 400 is functionally very similar to valve 300.

Figure 4:
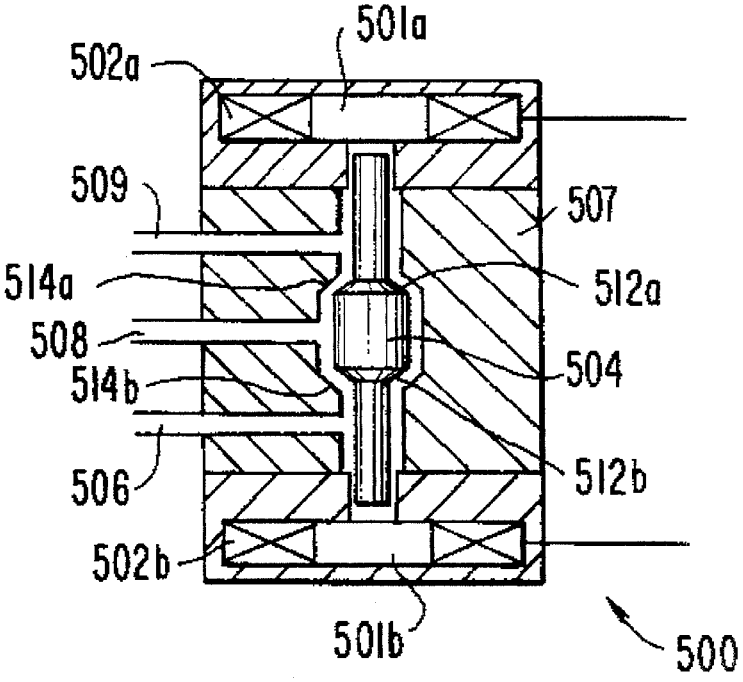
FIG. 4 is a simplified sectional view of still another type of electronically controlled trigger valve that can be used in the engine brake shown in FIG. 2.

FIG. 4 shows an illustrative two-coil poppet-type valve which is another example of a possible alternative to the trigger valve 300 shown in FIG. 2. In valve 500 shuttle 504 can be electromagnetically attracted to either pole piece 501*a* or pole piece 501*b* by electrically energizing either coil 502*a* or 502*b*, respectively. When shuttle 504 is pulled toward pole piece 501*a*, shoulder 512*a* on the shuttle seats against seat 514*a* on the interior surface of valve body or housing 507. This closes off port 508 from port 509. However, it allows hydraulic fluid to flow from port 506 through open seat 514*b* to port 508. On the other hand, when shuttle 504 is pulled toward pole piece 501*b*, shuttle shoulder 512*b* seats against valve body seat 514*b*. This closes off port 506 from port 508 but connects port 508 to port 509 via now-open seat 514*a*. Ports 506, 508, and 509 correspond, respectively, to ports 306, 308, and 309 in valve 300.

Figure 5:
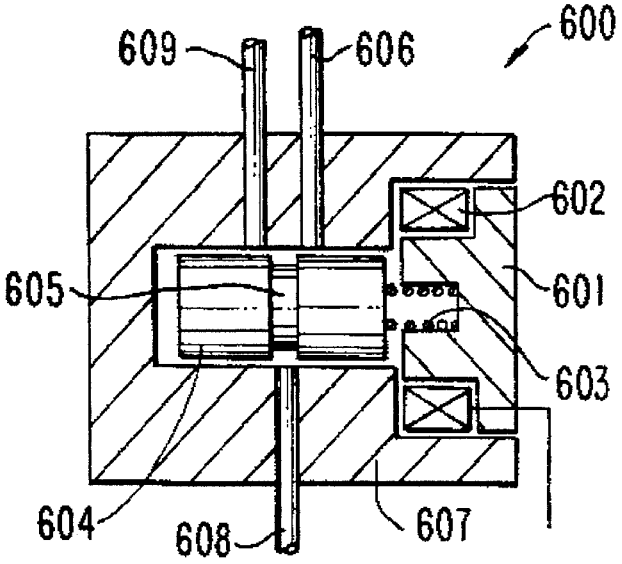
FIG. 5 is a simplified sectional view of yet another type of electronically controlled trigger valve that can be used in the engine brake shown in FIG. 2.

FIG. 5 shows an illustrative one-coil spool-type valve which is still another possible alternative to the trigger valve 300 shown in FIG. 2. Spool 604 is resiliently urged to the left by prestressed compression coil spring 603. In this position of the spool port 608 is hydraulically connected to port 609. When coil 602 is energized, spool 604 is electromagnetically attracted to pole piece 601. In this position of the spool port 608 is hydraulically connected to port 606. Spring 603 pushes spool 604 to the left again as soon as coil 602 is de-energized. Ports 606, 608, and 609 correspond, respectively, to similarly numbered ports in the previously described valves (e.g., to ports 306, 308, and 309 in valve 300).

Figure 6:
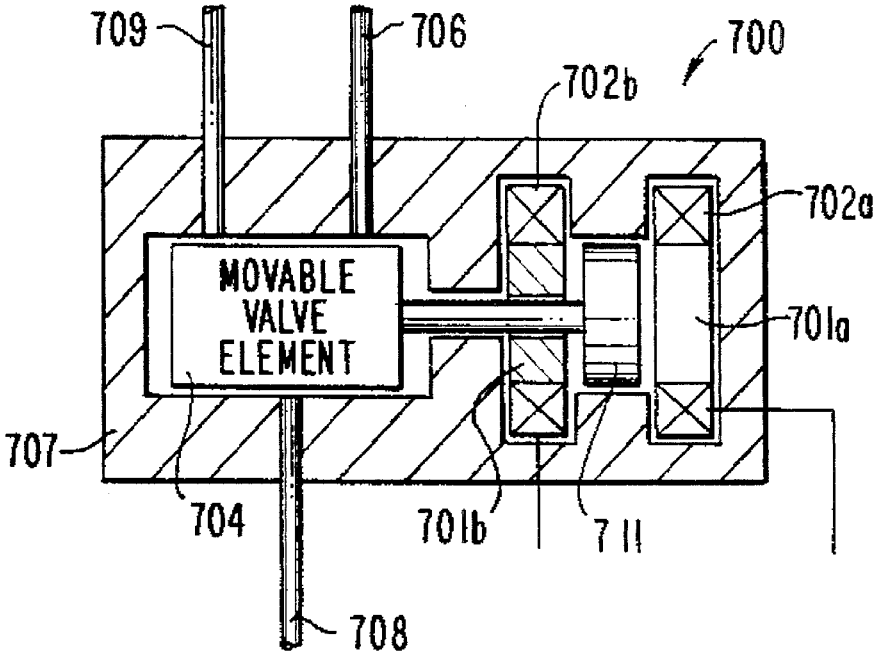
FIG. 6 is a simplified sectional view of still another type of electronically controlled trigger valve that can be used in the engine brake shown in FIG. 2.

Still another example of a possible trigger valve construction is shown in FIG. 6. In this construction two coils 702*a* and 702*b* are disposed on the same side of movable valve element 704 for shifting element 704 in either direction. In particular, when coil 702*a* is energized, valve driver 711 is electromagnetically attracted to pole piece 701*a* and thereby shifts movable valve element 704 to the right. On the other hand, when coil 702*b* is energized, valve driver 711 is electromagnetically attracted to pole piece 701*b* and thereby shifts movable valve element 704 to the left. Element 704 may be any type of movable valve element such as a spool or poppet of the types shown in the preceding FIGS. In its leftward position element 704 hydraulically connects ports 708 and 709. In its rightward position element 704 hydraulically connects ports 708 and 706. Once again, conduits 706, 708, and 709 correspond to similarly numbered conduits in previously described FIGS. such as conduits 306, 308, and 309, respectively, in FIG. 2.

Figure 7:
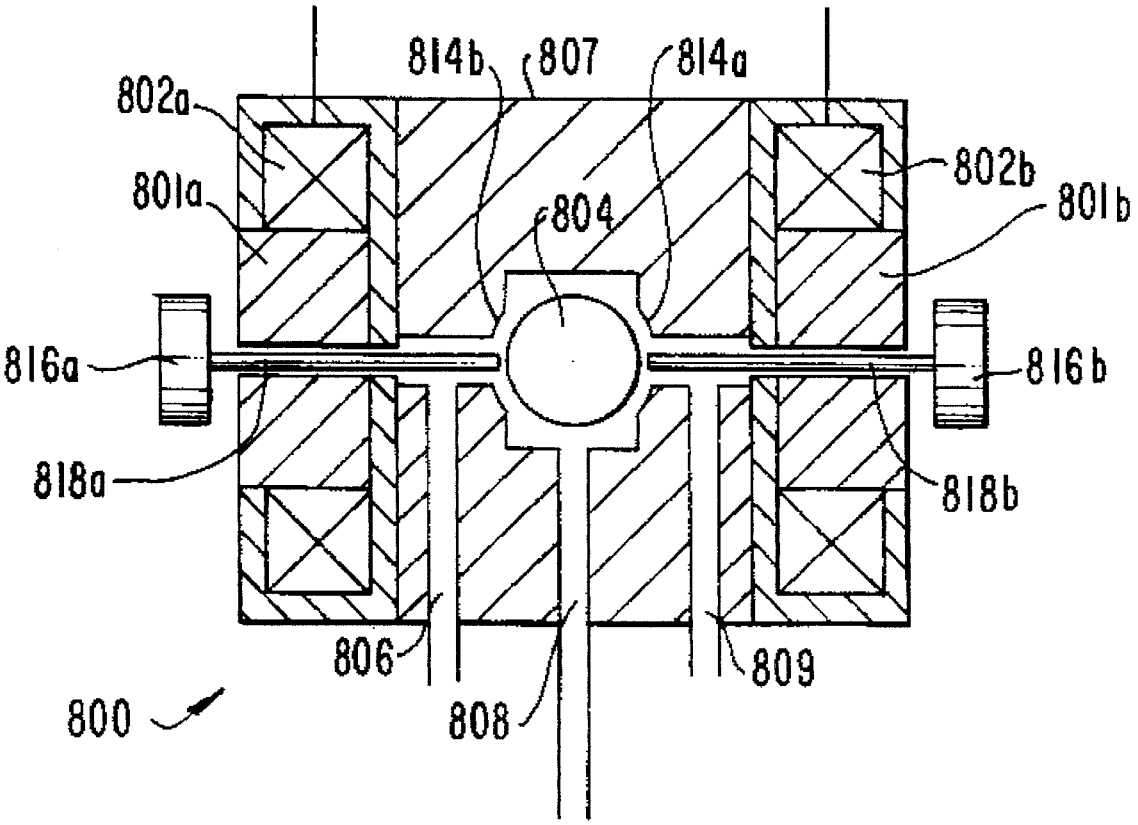
FIG. 7 is a simplified sectional view of yet another type of electronically controlled trigger valve that can be used in the engine brake shown in FIG. 2.

FIG. 7 shows yet another illustrative trigger valve construction. In trigger valve 800 energizing coil 802*a* electromagnetically attracts movable armature element 816*a* to pole piece 801*a*. This causes pin 818*a* to push ball 804 to the right against seat 814*a* formed in housing 807. With ball 804 in this position, valve conduits 806 and 808 are connected to one another and conduit 809 is closed. On the other hand, when coil 802*b* is energized, armature element 816*b* is electromagnetically attracted to pole piece element 801*b*. This causes pin 808*b* to push ball 804 to the left against seat 814*b*. With ball 804 in this position, valve conduits 808 and 809 are connected to one another and conduit 806 is closed off. Conduits 806, 808, and 809 correspond, respectively, to similarly numbered elements in previous FIGS. (e.g., to conduits 306, 308, and 309 in FIG. 2).

Figure 8:
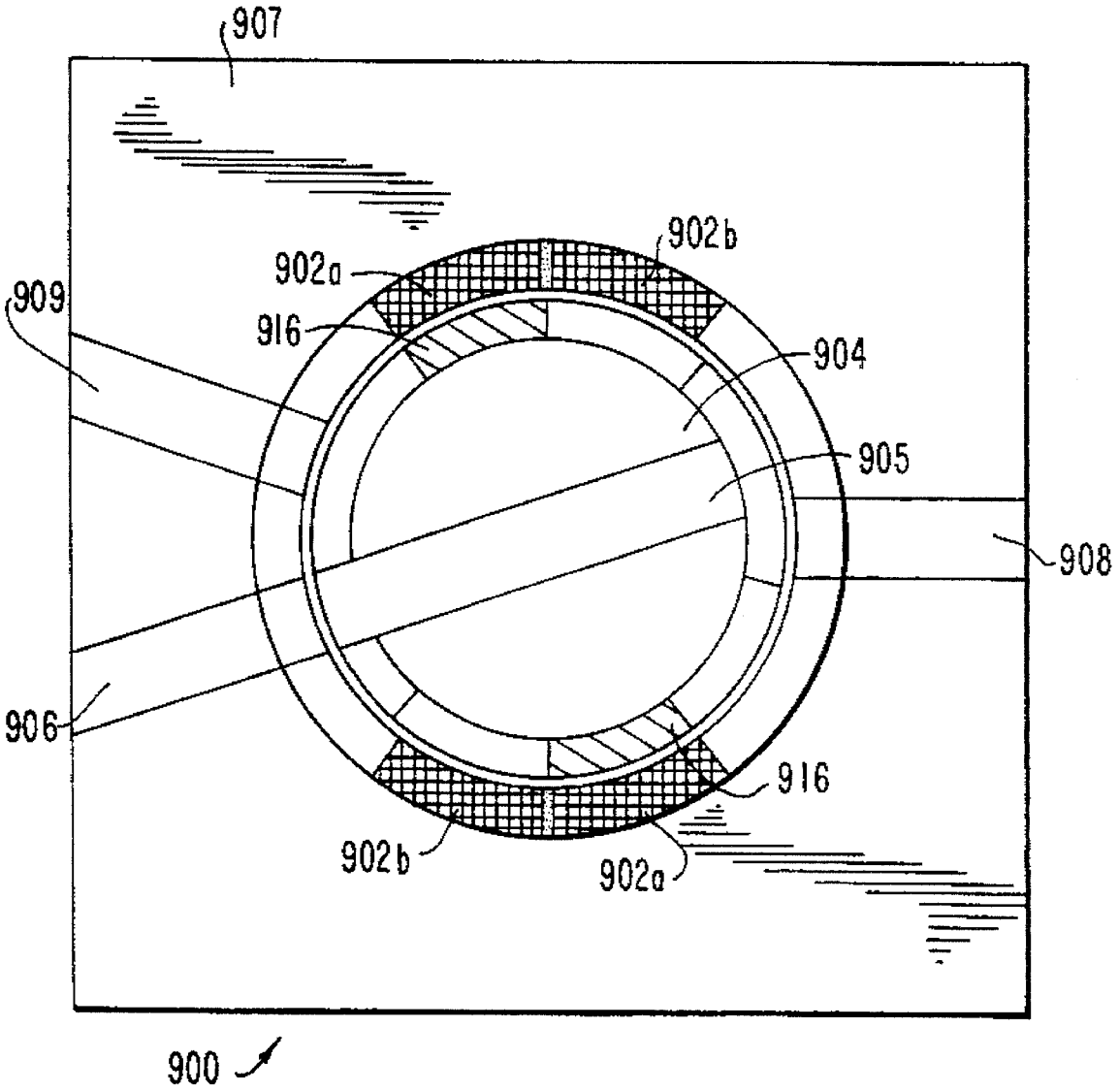
FIG. 8 is a simplified sectional view of still another type of electronically controlled trigger valve that can be used in the engine brake shown in FIG. 2.

Still another example of a suitable trigger valve is shown in FIG. 8. In valve 900 energization of coil 902*a* rotates ball or cylinder 904 to the depicted position due to the attraction of permanent magnets 916 on ball or cylinder 904 to the energized coil. This allows valve conduits 906 and 908 to communicate with one another through passageway 905 in ball or cylinder 904. Conduit 909 is closed off. On the other hand, when coil 902*b* is energized, ball or cylinder 904 rotates clockwise approximately 36° due to the attraction between coil 902*b* and magnets 916. This closes off conduit 906 and instead connects conduit 909 to conduit 908 through passageway 905. Once again, conduits 906, 908, and 909 correspond respectively to such conduits as 306, 308, and 309 in FIG. 2.

Although the valves shown in FIGS. 3–8 are three-way valves and are thus suitable for use in systems of the type illustrated by FIG. 2, these valves can alternatively be used as two-way (on/off) valves by omitting or not using port 409, 509, 609, 709, 809, or 909. The valves of FIGS. 3–8 are then suitable replacements for valve 100 in systems of the type illustrated by FIG. 1.

Figure 9:
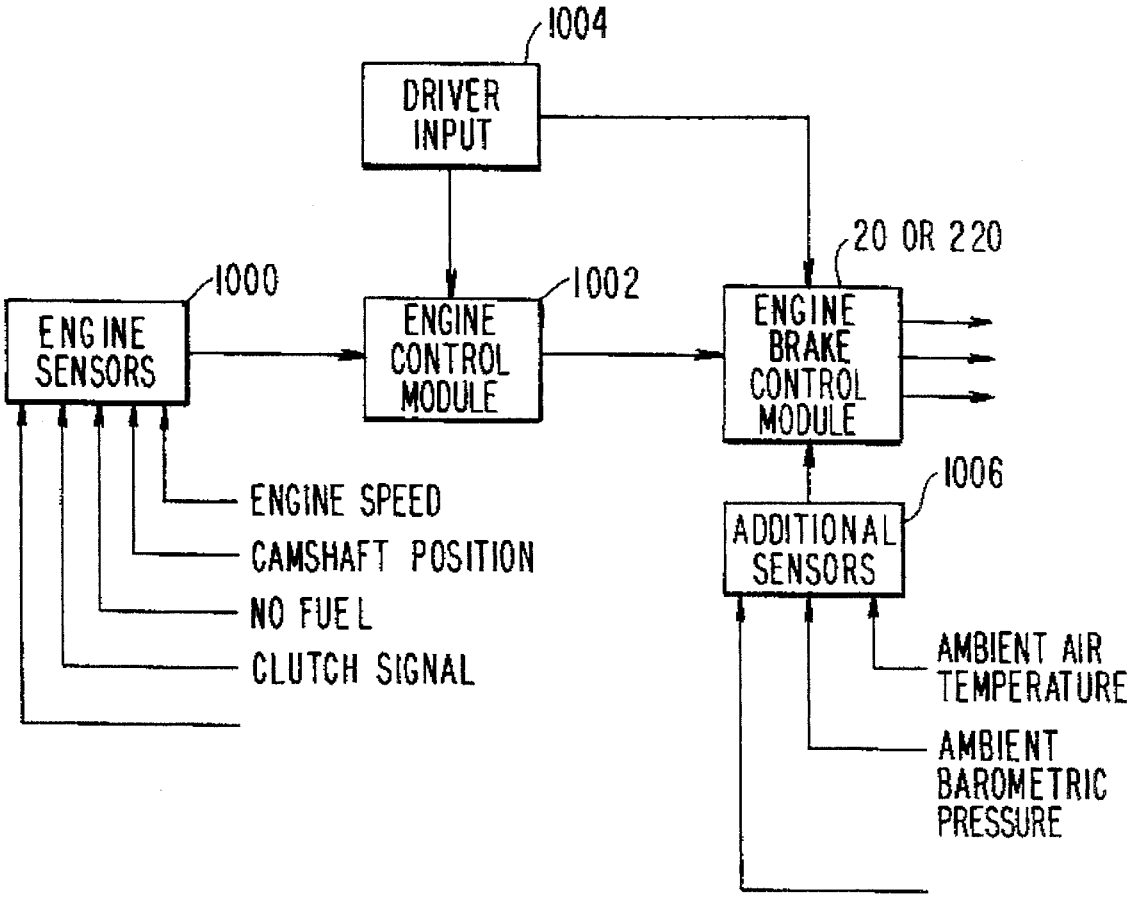
FIG. 9 is a simplified block diagram of illustrative control circuitry for the engine brakes of this invention.

FIG. 9 shows illustrative sources for the inputs to the engine brake control modules 20 or 220 shown in FIGS. 1 and 2. Conventional engine sensors 1000 sense such engine conditions as engine speed, camshaft position, no fuel being supplied, and clutch engaged. The output signals of sensors 1000 are applied to conventional engine control module 1002. The driver of the vehicle signals a desire for engine braking via conventional driver input 1004 (e.g., an on/off switch on the vehicle's dashboard). The output signal of element 1004 is applied to both engine control module 1002 and engine brake control module 20 or 220. Engine control module 1002 conventionally processes the signals it receives and provides outputs to engine brake control module 20 or 220 as are needed by the latter module. For example, if module 20 or 220 merely turns the associated engine brake on and off, engine control module 1002 may only need to output to module 20 or 220 such signals as (1) no fuel being supplied, (2) clutch engaged, and (3) engine camshaft position. On the other hand, if module 20 or 220 provides more sophisticated control of the associated engine brake (e.g., by automatically adjusting the timing of compression release events as described earlier), then engine control module 1002 may additionally output to module 20 or 220 such signals as (4) engine speed, (5) engine cylinder pressure, and/or (6) turbocharger boost pressure. Engine brake control module 20 or 220 may receive and act on still other inputs (either from engine sensors 1000 or directly via its own sensors 1006) such as ambient air temperature and/or ambient barometric pressure.

It will be appreciated that FIGS. 1 and 2 herein show only as much of the depicted engine brakes as is needed to produce compression release events in one engine cylinder. Those skilled in the art will understand that various components are typically duplicated to produce compression release events in the several cylinders of the usual multi-cylinder engines.

It will be understood that the foregoing is only illustrative of the principles of this invention and that various modifications can be made by those skilled in the art without departing from the scope and spirit of the invention. For example, although the illustrative systems shown herein produce compression release events by opening a conventional exhaust valve in the engine, a separate additional valve can alternatively be provided for such use. (See, for example, Gobert et al. U.S. Pat. No. 5,146,890.) Thus, it will be understood that terms like "exhaust valve" used herein include both conventional exhaust valves and additional special-purpose valves of the type shown by Gobert et al. As another example of modifications within the scope of this invention, more than one master piston can be used to pressurize the hydraulic fluid in plenum 60 or 260 via delay pistons 110 or 310. The master pistons are not necessarily operated by exhaust valve actuating mechanisms 90 or 290 but may be alternatively or additionally operated by other engine components such as intake valve actuating mechanisms or fuel injector actuating mechanisms.

The invention claimed is:

1. An engine brake for producing compression release events in an internal combustion engine by periodically opening an exhaust valve in the engine comprising:

a plenum into which hydraulic fluid can flow for storage in said plenum, said plenum being constructed to substantially prevent escape of hydraulic fluid from said plenum during operation of said engine brake;

a master piston reciprocated by a first part of the engine for hydraulically pressurizing hydraulic fluid in a hydraulic circuit during forward strokes of the master piston, said hydraulic fluid in said hydraulic circuit being separated from said hydraulic fluid in said plenum by a movable separator between said hydraulic circuit and said plenum so that pressurization of said hydraulic fluid in said hydraulic circuit pressurizes said hydraulic fluid in said plenum;

a slave piston; and an electronically controlled trigger valve for selectively allowing pressurized hydraulic fluid to flow from said hydraulic circuit to said slave piston to cause said slave piston to reciprocate and open said exhaust valve to produce a compression release event.

2. The apparatus defined in claim 1 wherein said trigger valve comprises:

a movable valve element; and an electrical coil for moving said valve element when an electrical current is passed through said coil.

3. The apparatus defined in claim 1 wherein said trigger valve has a first position in which it closes a first passageway between the hydraulic fluid pressurized by said plenum and said slave piston but opens a second passageway through which fluid can flow away from said slave piston, and a second position in which it closes said second passageway and opens said first passageway.

4. The apparatus defined in claim 1 wherein said engine opens said exhaust valve in synchronism with the angular position of an engine component, and wherein said apparatus further comprises:

a sensor for sensing the angular position of said engine component; and a control module responsive to said sensor for operating said trigger valve in synchronism with the sensed angular position of said engine component.

5. The apparatus defined in claim 4 further comprising:

a second sensor for sensing the speed of the engine, and wherein said control module is responsive to said second sensor for modifying the synchronism between operation of said trigger valve and the angular position of said engine component depending on the speed of the engine.

6. An engine brake for producing compression release events in an internal combustion engine by periodically opening an exhaust valve in the engine comprising:

a plenum containing hydraulic fluid;

a master piston reciprocated by a first part of the engine for hydraulically pressurizing the hydraulic fluid in the plenum during forward strokes of the master piston;

a slave piston; and an electronically controlled trigger valve for selectively allowing hydraulic fluid pressurized by said plenum to flow to said slave piston and to cause said slave piston to reciprocate and open said exhaust valve to produce a compression release event, wherein the hydraulic fluid in said plenum acts on a first end face of a delay piston, and wherein said master piston pressurizes hydraulic fluid which acts on a second end face of said delay piston, said first and second end faces being oppositely directed, and said delay piston being movable perpendicular to said end faces.

7. An engine brake for producing compression release events in an internal combustion engine by periodically opening an exhaust valve in the engine comprising:

a plenum containing hydraulic fluid;

a master piston reciprocated by a first part of the engine for hydraulically pressurizing the hydraulic fluid in the plenum during forward strokes of the master piston;

a slave piston; and an electronically controlled trigger valve for selectively allowing hydraulic fluid pressurized by said plenum to flow to said slave piston and to cause said slave piston to reciprocate and open said exhaust valve to produce a compression release event, wherein said trigger valve comprises:

a movable valve element;

a first electrical coil for moving said valve element in a first direction in response to passage of an electrical current through said first coil; and a second electrical coil for moving said valve element in a second direction opposite to said first direction in response to passage of an electrical current through said second coil.

8. An engine brake for producing compression release events in an internal combustion engine by periodically opening an exhaust valve in the engine comprising:

a plenum containing hydraulic fluid;

a master piston reciprocated by a first part of the engine for hydraulically pressurizing the hydraulic fluid in the plenum during forward strokes of the master piston;

a slave piston; and an electronically controlled trigger valve for selectively allowing hydraulic fluid pressurized by said plenum to flow to said slave piston and to cause said slave piston to reciprocate and open said exhaust valve to produce a compression release event, wherein said engine opens said exhaust valve in synchronism with the angular position of an engine component, and wherein said apparatus further comprises:

a sensor for sensing the angular position of said engine component;

a control module responsive to said sensor for operating said trigger valve in synchronism with the sensed angular position of said engine component; and a second sensor for sensing ambient air temperature, wherein said control module is additionally responsive to said second sensor for modifying the synchronism between operation of said trigger valve and the angular position of said engine component depending on said ambient air temperature.

9. An engine brake for producing compression release events in an internal combustion engine by periodically opening an exhaust valve in the engine comprising:

a plenum containing hydraulic fluid;

a master piston reciprocated by a first part of the engine for hydraulically pressurizing the hydraulic fluid in the plenum during forward strokes of the master piston;

a slave piston; and an electronically controlled trigger valve for selectively allowing hydraulic fluid pressurized by said plenum to flow to said slave piston and to cause said slave piston to reciprocate and open said exhaust valve to produce a compression release event, wherein said engine opens said exhaust valve in synchronism with the angular position of an engine component, and wherein said apparatus further comprises:

a sensor for sensing the angular position of said engine component;

a control module responsive to said sensor for operating said trigger valve in synchronism with the sensed angular position of said engine component; and a second sensor for sensing ambient barometric pressure, wherein said control module is additionally responsive to said second sensor for modifying the synchronism between operation of said trigger valve and the angular position of said engine component depending on said ambient barometric pressure.

* * * * *